US006973893B2

(12) United States Patent
Holmes

(10) Patent No.: US 6,973,893 B2
(45) Date of Patent: Dec. 13, 2005

(54) SUBMARINE GUIDANCE SYSTEM

(76) Inventor: Ian Charles Holmes, Flat D, 315 Old London Rd ORE, Hastings, TN35 5BA (GB)

( * ) Notice: Subject to any disclaimer, the term of this patent is extended or adjusted under 35 U.S.C. 154(b) by 0 days.

(21) Appl. No.: 10/788,450

(22) Filed: Mar. 1, 2004

(65) Prior Publication Data

US 2005/0166827 A1 Aug. 4, 2005

(51) Int. Cl.[7] ..... B63G 8/14
(52) U.S. Cl. ..... 114/330; 114/312
(58) Field of Search ..... 114/312, 330

(56) References Cited

U.S. PATENT DOCUMENTS 3,018,748 A 1/1962 Denis
3,035,536 A * 5/1962 Archer ..... 114/77 R
3,903,825 A 9/1975 Hamy
2001/0018886 A1 * 9/2001 Holmes ..... 114/312

FOREIGN PATENT DOCUMENTS

GB 2354490 3/2001

* cited by examiner

*Primary Examiner*—Jesus D. Sotelo

(57) ABSTRACT

A submersible vehicle comprising a plurality of rigid submersible vessels 2, 3, some of which, 2, include propulsion means and some of which, 3, do not include propulsion means, the rigid submersible vessels being coupled by resilient couplings which are adapted to transmit pulling and braking forces between adjacent rigid submersible vessels. Steering means and position sensing means is provided on at least some of the submersible vessels whereby to ensure that the following submersible vessels follow exactly the lead vessel to avoid fixed obstructions.

15 Claims, 9 Drawing Sheets

SUBMARINE GUIDANCE SYSTEM

BACKGROUND OF THE INVENTION

This invention relates to a submersible vehicle.

According to the invention there is provided a submarine comprising a plurality of rigid submersible vessels coupled by resilient couplings.

Hitherto it has been difficult to provide a large submarine. When submerged the submarine which is essentially a tube with the ends capped is subject to external hydrostatic pressure. To prevent crushing of the tube the walls must be thick. The greater the diameter of the tube the thicker the walls need to be. A smaller diameter tube can be thinner but of course needs to be longer to have the same volume. While the same amount of material or indeed slightly for the same internal volume more may be required with the smaller tube, it is much easier to manipulate and form thin plate than thick. However a large volume submarine of small diameter will be very long since halving the diameter of a tube reduces its volume by a factor of four. A very long thin conventional submarine would be difficult to control.

Reference may be made to U.S. Pat. No. 3,809,002 in which there is disclosed a number of small submarines joined end to end which at least partly meet the above problem. However for such an arrangement to be practical, it is necessary to accurately control and navigate the various components of the submarine.

SUMMARY OF THE INVENTION

The present invention provides a submarine characterised in that it comprises a plurality of rigid submersible vessels coupled by resilient couplings.

This provides the advantage of a small submarine (greater strength without the disadvantage of unwieldy handling of a long narrow submarine).

Whilst the invention may only include two submarines coupled together, we envisage that in practice a larger number of submarines may be connected together to provide the major benefit of the invention.

However, in coupling two or more submarines together, problems have to be overcome. Firstly, if the submarines were simply connected to one another by means of a cable or hawser, then whilst this may have limited use where only the front submarine is driven, there are difficulties when the submarines slow down and come to a halt in that there will be nothing to stop the rear submarines hitting the forward submarines, and perhaps the submarines ending up "jack-knifing" into a disorganised array both in the horizontal and the vertical direction.

Furthermore, particularly where a considerable number of submarines are coupled together, it is necessary to provide some means whereby the following submarines follow the same path as the lead submarine. This is particularly desirable when the submarine is in the vicinity of fixed obstructions such as rocks or shoals at sea, or it is moving into a harbour or up a river where it will need to follow a fixed path to keep to, for example, a dredged channel. The submarines will be acted upon by, for example, sideways currents, (of which there are many of considerable magnitude) and the tendency will be for the following submarines to be displaced sideways (with respect to their positions relative to the earth's surface) in respect to the path followed by the lead submarine.

Also, there are problems in relation to maintaining the following submarines at the same depth as the lead submarine. For example there may be changes of water density or temperature which can be quite localised and which will cause following submarines to move up or down or the water may become shallow, particularly in rivers or estuaries. Also, if the submarine is following a relatively shallow path, that is following a relatively shallow path, that is a relatively small distance below sea level, it may be affected to an extent by wave motion, and also there may be occasions where it needs to dive deeper under some kind of floating obstruction and once again, as the lead submarine dives below the obstruction, it is essential for the following submarines to follow the same path and dive beneath the same obstruction.

The present invention provides a submersible vehicle comprising a plurality of rigid submersible vessels coupled together end to end by resilient couplings, at least some of said rigid submersible vessels including means to independently steer the vessel, said steering means comprising, for example, vertical and/or horizontal fins, at the front and/or the rear of the vessel, and/or side and/or up and down thrusters provided at the front and/or rear of the vessel, at least some of the submersible vessels, and the lead submersible vessel including position tracking means, such as a gyroscopic system or a global positioning tracking system (GPS) whereby the position of the relevant vessel may be accurately tracked, and computer means may be provided so as to cause said at least some submersible vessels to control their steering means whereby the following submersible vessels follow the path of the lead submersible vessel.

The submersible vessels may be connected by a cable which allows the data with regard to the positioning system of the submersible vessels to be transferred between submersible vessels.

BRIEF DESCRIPTION OF THE DRAWINGS

Embodiments of the invention will be described by way of non-limiting example with reference to the accompanying figures of which.

DESCRIPTION OF THE PREFERRED EMBODIMENTS

Figure 1:
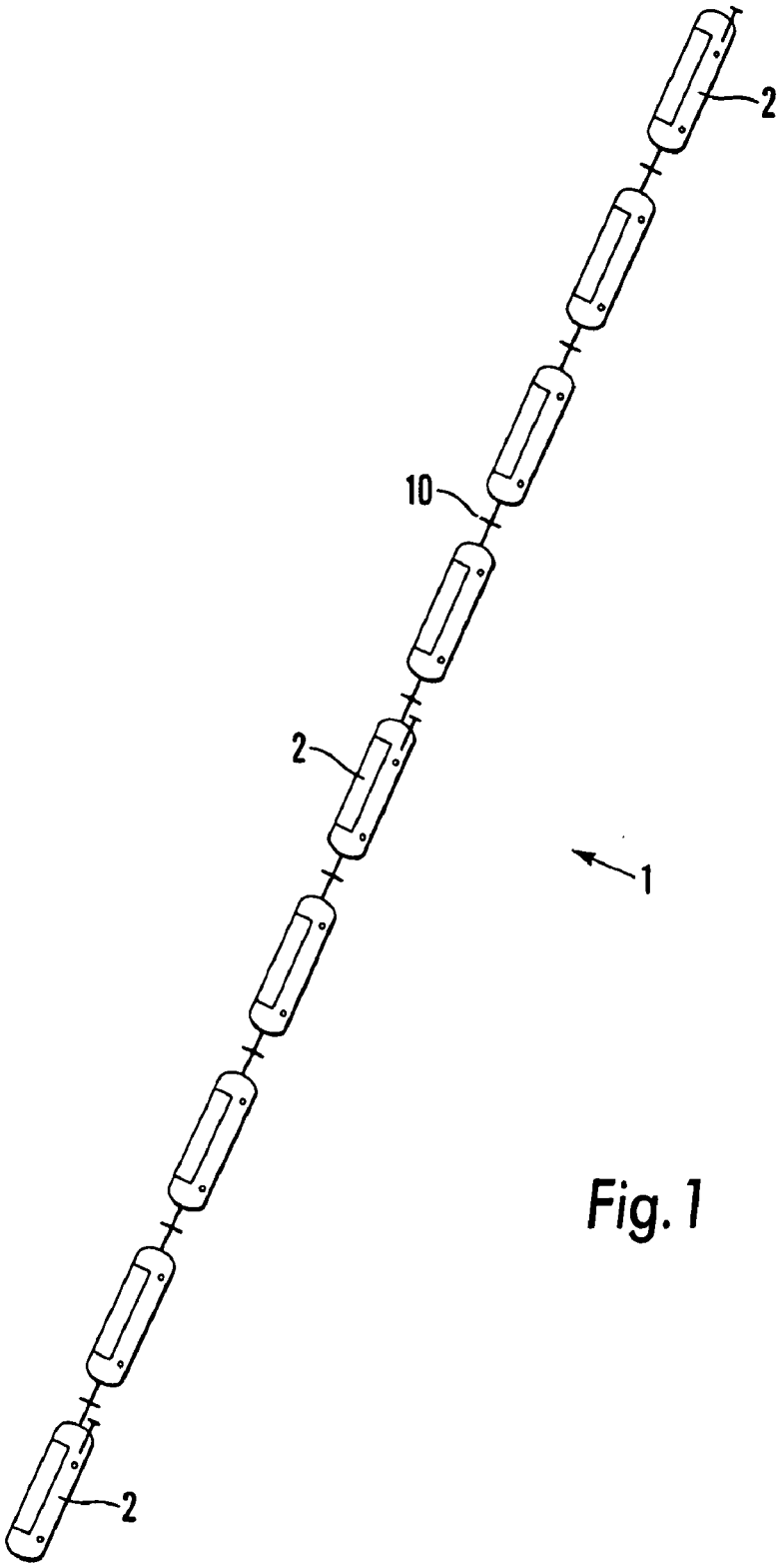
FIG. 1 is a schematic side elevation of a vehicle.
Figure 2:
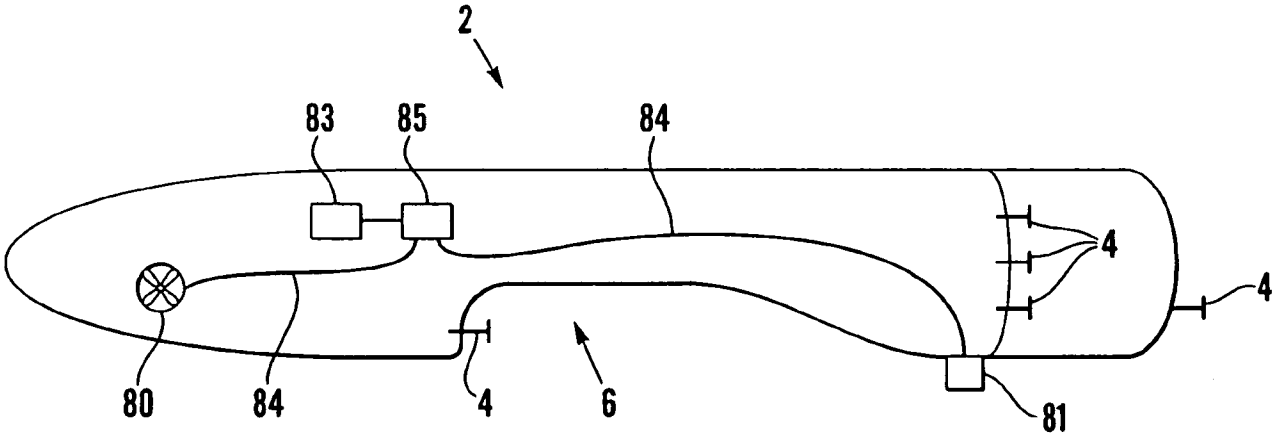
FIG. 2 is a schematic side elevation of a vessel.

Vehicle 1 comprises a plurality of rigid pressure vessels forming submarine vessel 2 connected together as will be described hereinafter. At least some vessels 2 are provided with propulsion means to drive the vessel, for example, by means of propellers, the remainder of the vessels 3 not including propulsion means. Typical dimensions for those vessels 2 which include propulsion means are 80 m–200 m, preferably 100 m or 150 m length, and for those vessels 3 which do not include propulsion means, 50 m–100 m, preferably 75 m length; in each case the outer diameter may be for example from 2 m to 10 m, preferably 7 m. In the embodiment of FIG. 1 the front and rear vessels and one other include propulsion means, the other vessels having, save as hereinafter described, no propulsion means. As seen in FIG. 2, at least some of the vessels may have means for steering horizontally and/or vertically, said steering means comprising, vertical and/or horizontal fins and/or side and/or up and down thrusters mounted at the front and/or the rear of the vessel. The steering means may comprise one or more of rudders 81, hydroplanes, side thrusters 80, and motion sensors 83 in the vessel connected by a computer system may be used. The components 80, 81, 83, 85 may be connected by cables 84. There may be provided ballast tanks and propellers which may be disposed in each side and/or above and/or below the axis of the vessel which may be independently driven Those skilled in the art will have little difficulty in devising other suitable means for adjusting the steering in the horizontal and vertical plane.

Figure 11:
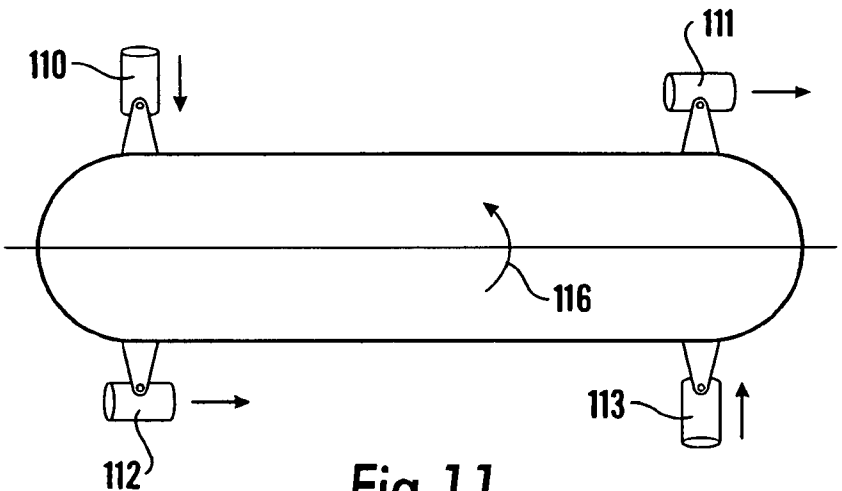
Figure 9:
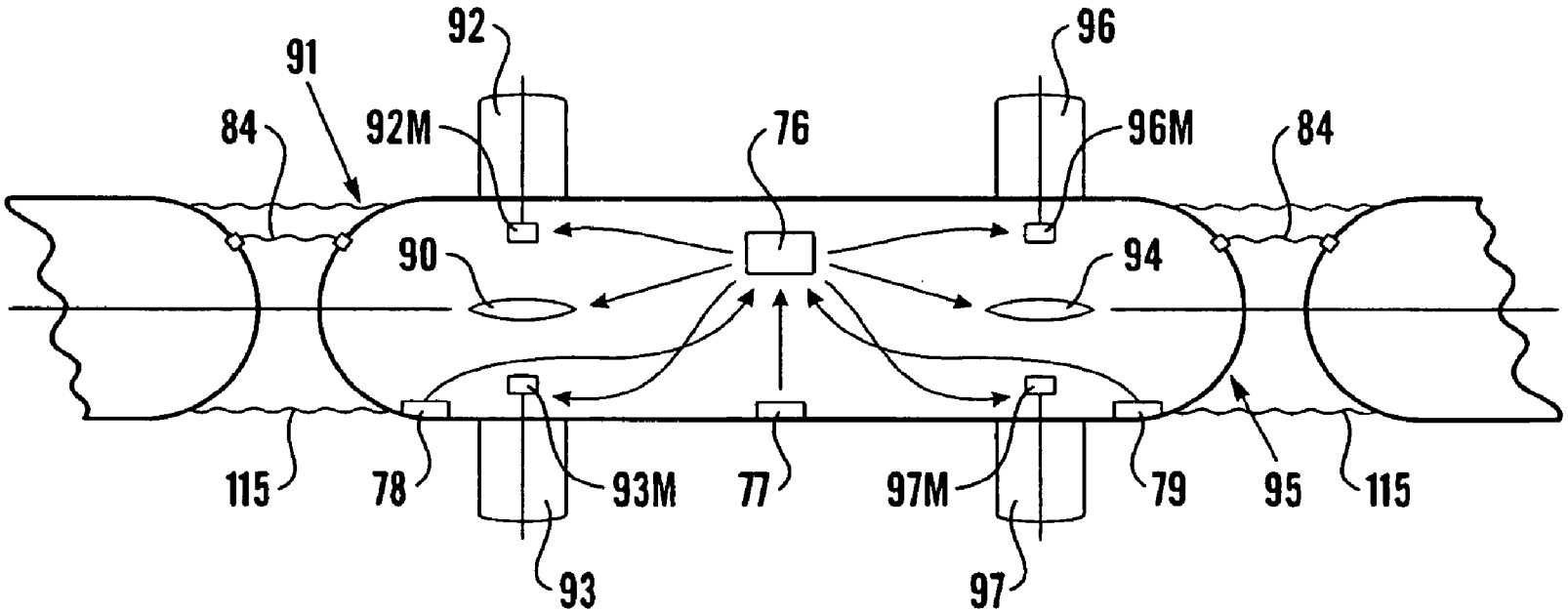
FIG. 9 is a side view of a preferred embodiment of a submersible vessel.
Figure 10:
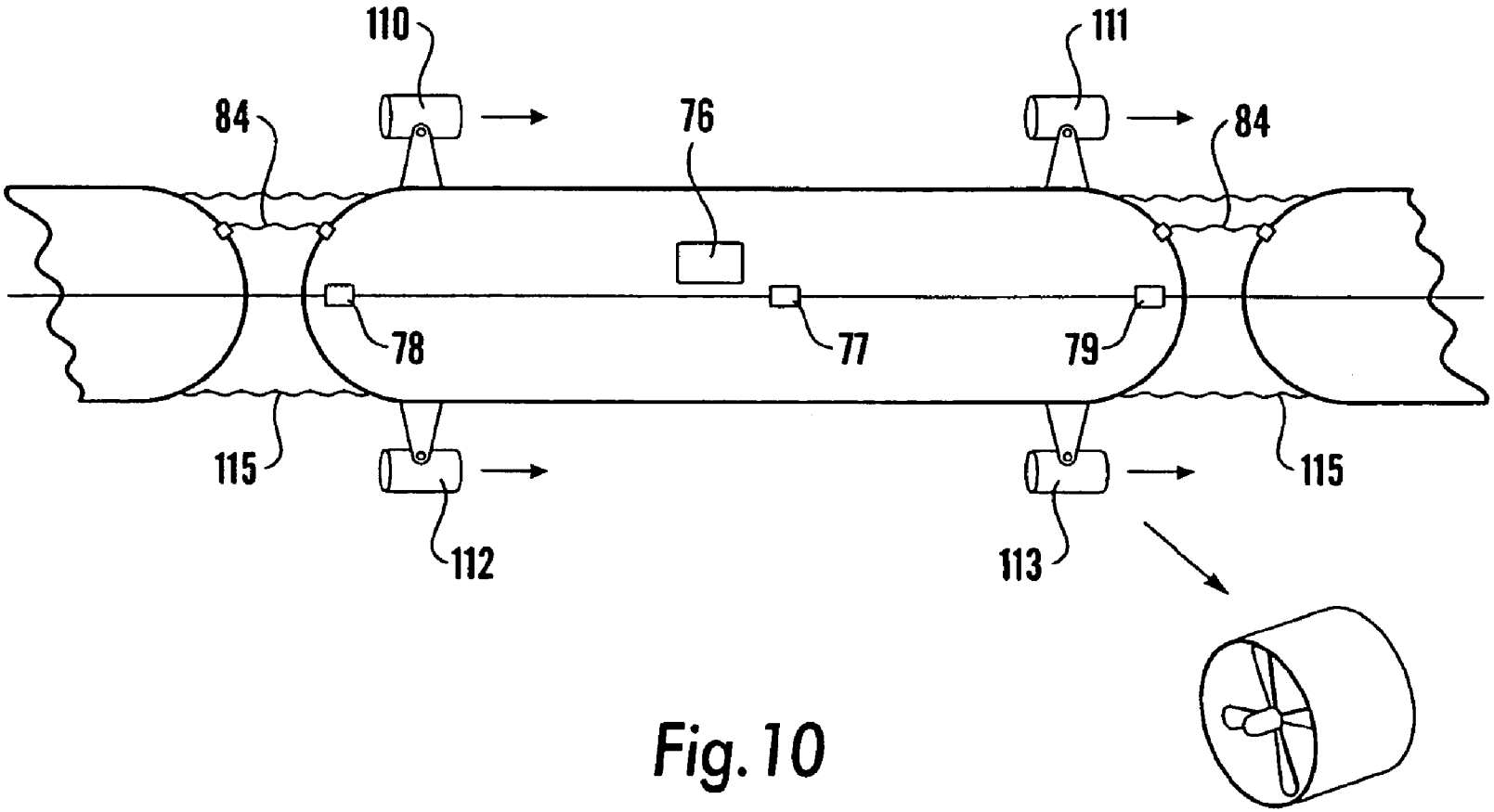
FIG. 10 is a plan view of a yet further preferred embodiment of a submersible vessel; and, FIG. 11 is a plan view of the vessel of FIG. 10 but with some of the side thrusters pointing in a different direction.

In alternative arrangements shown in FIGS. 9 to 11, FIG. 9 shows a side view of a submersible vessel, it will be seen that the vessel includes, at its forward end, a pair of horizontal fins 90, 91, and a pair of vertical fins, 92 above the submarine and 93 below the vessel, and a similar combination of horizontal fins 94, 95 and vertical fins 96, 97 at its rear end. The submarine vessel may include 8 such fins but in practice more limited numbers may be used. For example in one configuration the submarine vessel may include only the forward fins 90, 91, and 92. In an alternative embodiment, it may include only the rear fins 94, 95, and 96. Each fin is pivotable about an axis there through and is mounted to the submarine vessel by a suitable rotatable bearing, the submarine including a suitable motor, such as an electric or hydraulic motor (e.g. 92M, 93M, 96M, 97M) to rotate the relevant fin under the control of a computer 76.

The vessel also includes one or more position sensors 77 towards the centre of the submersible vessel or position sensors 78 or 79 provided adjacent the front or rear end respectively of the submersible vessel. Once again the relevant position sensor 77–79 is connected to the computer 76 and the computers in each vessel may be connected together by cables 89. Alternatively, the position sensors 77–79 may be connected via the cable 89 to a central computer in one of the vessels which has overall control and directs the fins on all of the vessels.

In the alternative arrangement of FIG. 10, in place of the fins, there may be provided thrusters 110, 111, 112 and 113. Thus FIG. 10, which shows a plan view of the submersible vessel, shows thrusters 110 and 111 mounted on each side of the front end of the vessel, and thrusters 112 and 113 mounted on each side of the rear end of the vessel. The thrusters 110–113, which are well known in the art, comprise shrouded propellers driven by an electric or hydraulic motor, the shrouds being mounted so as to be rotatable about a vertical axis in FIG. 10. In this way the thrusters 110–113 may be driven to either direct the submersible vessel in a forwards direction as shown in FIG. 10 (or rearwards for braking) or with the thrusters 110 and 113 rotated at right angles, (see FIG. 11) in such a direction as to rotate the submersible vessel generally in the direction shown by arrow 116.

The submersible vessel shown in FIGS. 10 and 11 may include one or more position sensors of the type and disposition shown in FIG. 9.

Furthermore there may be provided a computer 76 of a similar type to that shown in FIG. 9 which controls the movement of the thrusters 110–113 about the vertical axis and also may be used to control the speed of rotation of the thrusters. Once again, it may be sufficient to simply have one pair of thrusters, for example thrusters 110, 111 or thrusters 112, 113.

Those skilled will have little difficulty in devising suitable power sources to drive the hydraulic or electric motors. In many cases the ultimate drive will be by hydraulic or electric motor (although this is not essential). Those skilled will have little difficulty in devising suitable sources of electricity. Non-limiting examples include batteries, electric generators drive by an internal combustion engine (particularly during shallow dive when a schnorkel may provide air from the surface. or nuclear reactor driven electric power generators.

Figure 3:
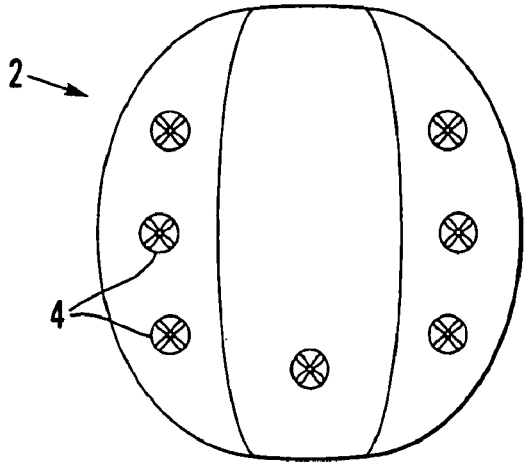
FIG. 3 is a schematic side end elevation of the vessel of FIG. 2.

Vessels 2, 3 are rigid pressure vessels broadly similar to the pressure vessel of a conventional submarine. In the embodiment illustrated, vessel 2 is of the order of 150 m long. As can be seen from FIG. 3 a plurality of propellers 4 are fitted toward the stern of the vessel. A plurality of propellers are in this embodiment provided part way along the vessel 2 in recess 6. While a plurality of propellers and hence in some cases a plurality of drive motors results in increased weight, maneuverability may be increased and incapacity of one propeller will have little effect upon the speed or maneuverability of the vessel.

Many embodiments of the invention will be manned. Manning may be by passengers and/or crew. Life support systems and accommodation may thus be required. Windows may be provided.

In the invention a plurality of joined submarine vessels are provided. A coupling 10 is provided between adjacent vessels which may transmit pulling and braking forces between them. A flexible non-resilient coupling will have a tendency to 'jack-knife'.

Figure 4:
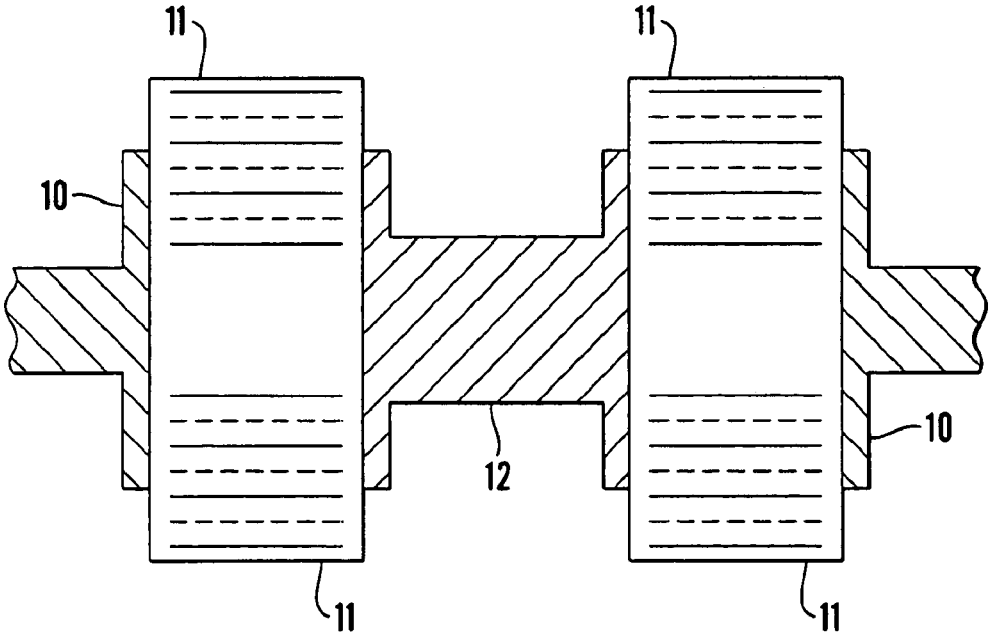
FIG. 4 is a schematic cross-section of a first coupling.

An example of a suitable resilient coupling is illustrated in FIG. 4. A base plate 10 is provided at the front and rear of each vessel 2, 3 generally on the axis of the vessel 2, 3. A cylinder, or preferably an annulus 11 of resilient matter, for example, rubber is mounted on the base plate 10. Each base plate 10 is connected by adhesive or by bolts to one side face of the respective annulus 11. A coupling plate 12 is secured by adhesive or bolts to the second side face of each annulus 11 to form a coupling. The attachment could be achieved by bolts (not shown) passing through holes in the base plate 10, resilient matter 111 and coupling plate 12.

The coupling of FIG. 4 allows two submarines connected by such coupling to move such that their axes can move at a slight angle to one another to a limited extent. This allows the two submarines to be able to absorb different sideways and up-and-down forces applied to them, for example, during a turning manoeuvre, but maintains them generally in a co-axial alignment so that braking forces can be transmitted effectively. The maximum angle between adjacent vessels 2, 3 will be limited to a maximum of 10°, preferably 5°, preferably still 2½°, the exact angle depending on the length of each vessel and other factors. The coupling allows both pulling and braking forces to be transmitted between adjacent submarines.

Figure 5:
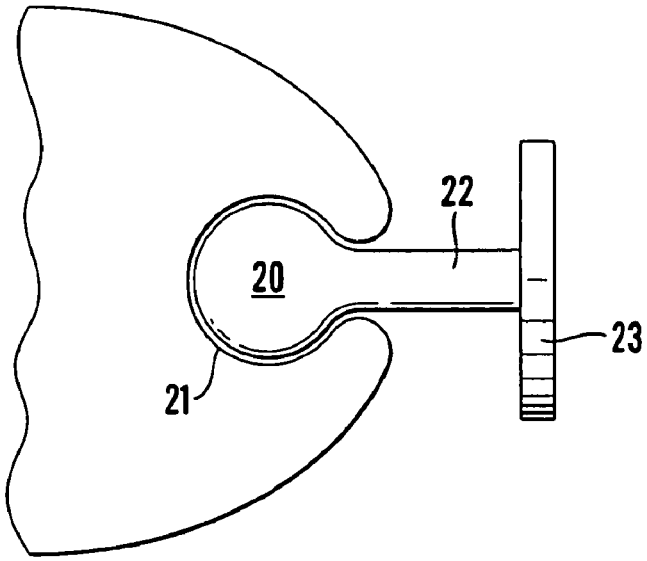
FIG. 5 is a schematic scrap view of a second coupling.

FIG. 5 shows a further suitable resilient coupling in which a ball 20 is received in a socket 21 of the vessel. Stalk 22 attached to ball 20 is of resilient material. Stalk 22 terminates in flange 23 which need not be resilient material. A coupling of a first vessel is bolted by flange bolts 24 to a coupling of a second vessel.

Whilst the arrangement as shown in FIG. 5 will allow for transmission of pulling forces between two adjacent submarines, the use of braking forces will cause the submarines to "jack-knife" unless there is provided in the coupling resistance to angular deflection between the axes of the two adjacent submarines. This may be provided by, for example, a very tight fit between the ball 20 and socket 21 or by providing between the ball and socket resilient material, for example, rubber, which is bonded to the ball and socket and which flexes to allow the ball and socket to move slightly with respect to one another or by a physical detent restricting deflection. The coupling of FIG. 5 allows two submarines connected by such coupling to move such that their axes can move at a slight angle to one another to a limited extent. The maximum angle between adjacent vessels 2, 3 will be limited to a maximum of 10°, preferably 5°, preferably still 2½°, the exact angle depending on the length of each vessel and other factors. This allows the two submarines to be able to absorb different sideways or up-and-down forces applied to them, for example, during a turning manoeuvre or by currents, but maintains them generally in a co-axial alignment. The coupling allows both pulling and braking forces to be transmitted between adjacent submarines.

In addition to or in place of the resilient nature of the connection between adjacent submarines, the submarines can be maintained in line by means of the fins and/or thrusters illustrated in FIGS. 9, 10 and 11.

Figure 6:
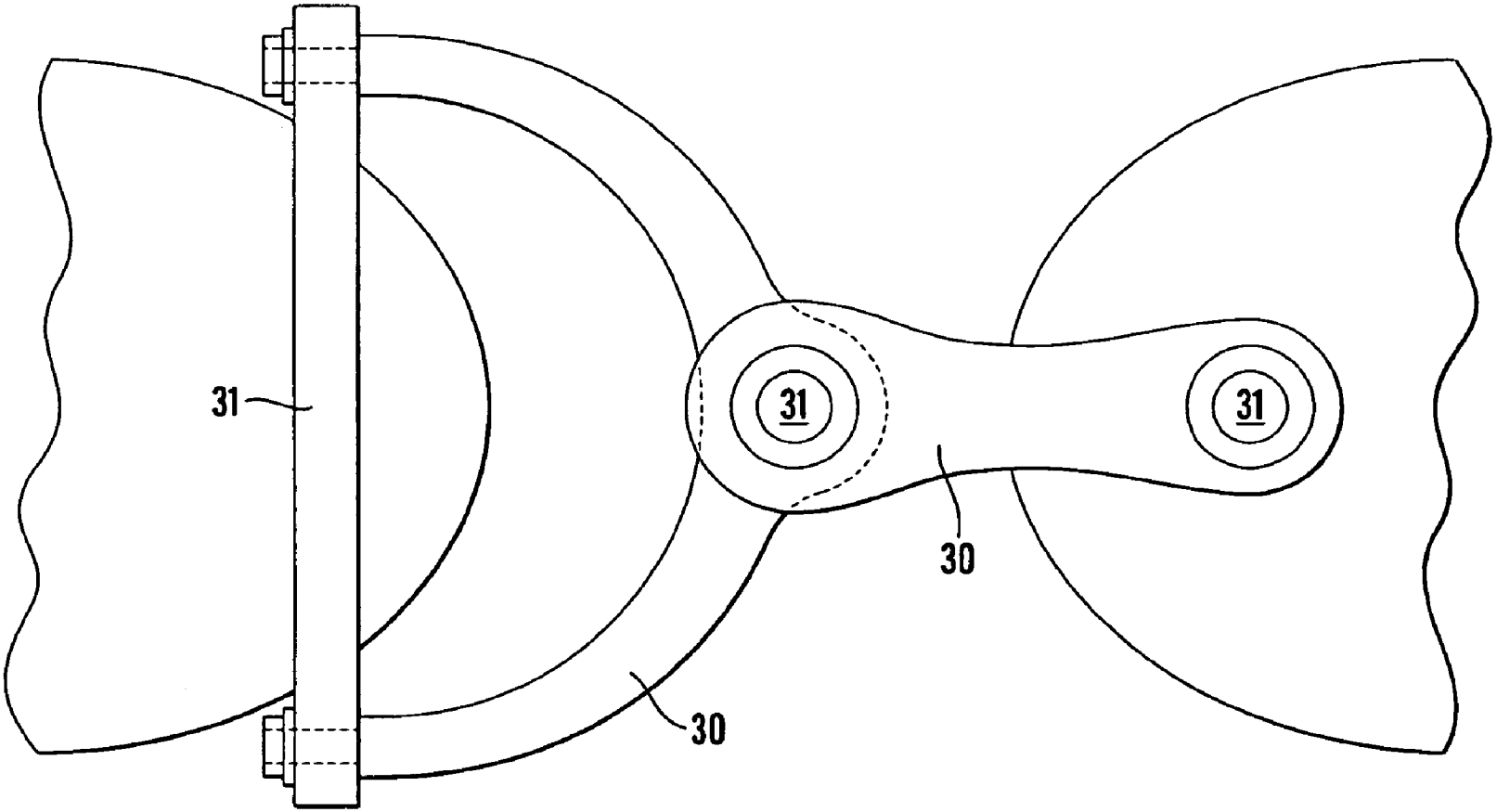
FIG. 6 is a schematic partially cutaway view of a third coupling.

FIG. 6 shows a coupling comprising a yoke 30 pivotally mounted to each vessel by pivot pin 31. Yokes 30 of adjacent vessels are joined by coupling pin 31. Preferably coupling pin 31 is substantially vertical to allow easy fitment and removal.

Whilst the arrangement as shown in FIG. 6 will allow for transmission of pulling forces between two adjacent submarines, the use of braking forces will cause the submarines to "jack-knife" unless there is provided in the coupling resistance to angler deflection between the axes of the two adjacent submarines. This may be provided by, for example, a very tight fit between the yoke 30 and pivot pin 31 or by providing between the yokes and pins a resilient material, for example, rubber, which is bonded to them and which flexes to allow the yokes to move axially slightly with respect to one another (or by physical detents). The maximum angle between adjacent vessels 2, 3 will be limited to a maximum of 10°, preferably 5°, preferably still 2½°, the exact angle depending on the length of each vessel and other factors.

Figure 4A:
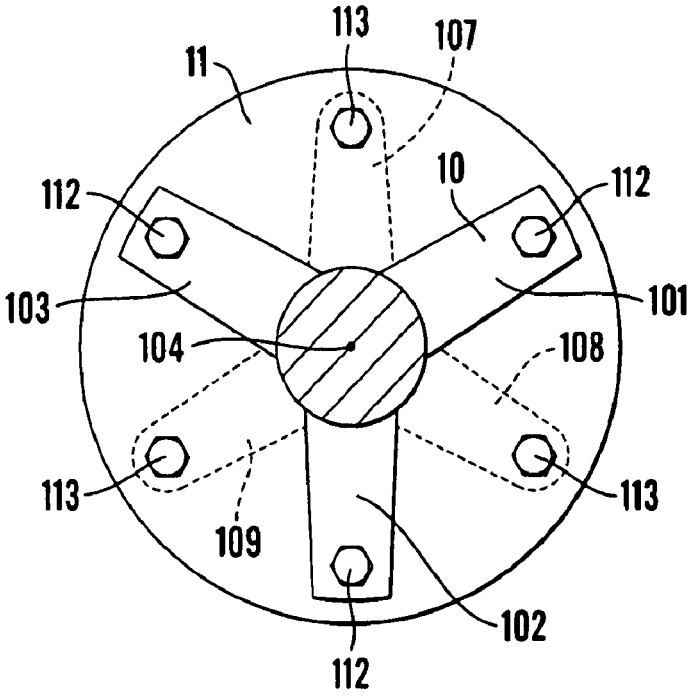
FIG. 4A is an end view of an alternate version of the first coupling of FIG. 4.

In an alternative arrangement of the resilient coupling of FIG. 4, the base plate 10 may be shaped so as to provide a number of equiangular spaced fingers 101, 102, 103 extending away from the axis 104 of the base plate 10. As a typical example there may be provided three equiangularly disposed fingers. Similarly the plate 106 of the coupling plate 12 which is to be secured to the annulus 11 may comprise a similar number of equiangularly radially disposed fingers 107, 108, 109 and the configuration is such that the fingers of the coupling plate 12 and the fingers of the base plate 10 are radially displaced from one another. Thus a respective bolt 112 may be passed through the annulus 11 to couple each finger of the base plate 10 to the annulus 11, and similarly bolts 113 may pass through the annulus 11 to couple the fingers of the coupling plate 12 to the annulus 11. In this way the annulus 11 may flex between adjacent fingers and this allows for a resilient coupling. Such an arrangement is illustrated in FIG. 4A. The maximum angle between adjacent vessels 2, 3 will be limited to a maximum of 10°, preferably 5°, preferably still 2½°, the exact angle depending on the length of each vessel and other factors.

Various other couplings may be devised but the preferred features of them are that there is provided limited resilient axial displacement of adjacent submarines, and there is the ability to transmit both braking and pulling forces between the submarines.

As will be clearly understood, one way to avoid jack-knifing of the vessel is by braking the vessel from the rear-most submarine first. Thus the rear-most submarine may be arranged to be driven backwards under braking and similarly the vessels just in front of the rear-most vessel. Thus the rear-most vessel may, when sharp braking is required, be arranged so as to have its drive means fully in reverse, and successive submarines in front of the rear submarine may also be arranged to drive rearwardly but to a lesser extent. The forward vessels may continue to drive at least to a limited extent which would effectively keep the submarine vessel "taut" thus preventing jack-knifing.

Motion sensors in the vessel connected to a computer system may be used somewhat along the lines of 'fly-by-wire' systems (i.e. the controls and the means which is to be controlled—the fins or thrusters—are not directly connected together by means of rods or links but the manual or automatic control provides an electrical signal which is used to operate an actuator in accordance with the signal, the actuator being connected to and arranged to operate the means to be controlled) such as provided in aircraft to maintain the submarines in suitable alignment.

Figure 7:
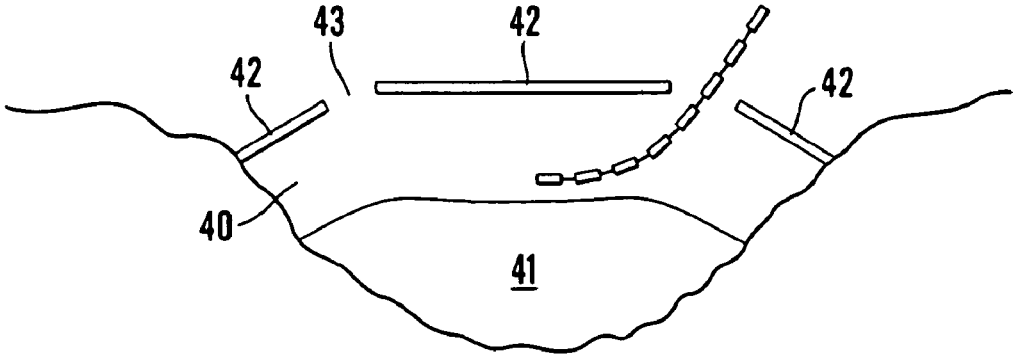
FIG. 7 is a plan view of a harbour.

The submarine of the invention may be very long: lengths of 1200 m are envisaged. FIG. 7 illustrates one way in which the submarine may be docked. Bay 40 is provided with landing area 41 and breakwaters 42. Breaks 43 in breakwaters 42 allow the submarine to leave and depart the landing area in an arcuate fashion.

A flexible curtain 115 (see FIGS. 9 and 10) may be provided between each submarine vessel so as to improve the streamline nature of the complete vehicle.

It will be clear from FIG. 7 that there are likely to be problems, particularly when close to shore or entering a harbour or estuary, in the submarine passing close to fixed obstructions such as the breakwaters 42, or, indeed, at sea passing rocks, buoys or shoals. This would be particularly disastrous where the submarines carried dangerous or environmentally unsafe material such as oil.

The difficulty is primarily that whilst the lead submersible vessel may pass the relevant obstruction, unless the following submersible vessels follow exactly the same path in the horizontal (and vertical) plane some of the rearward submersible vessels may collide with the breakwater or rocks or shoals. It is therefore desirable to be able to operate the submersible vessels so that each of the vessels passes through the same point with respect to the earth's surface.

The means described with reference to FIGS. 9, 10 and 11 may be utilized for this purpose. The motion sensors which may comprise extremely sensitive gyroscopes from which the position of the relevant vessel or part of the relevant vessel may be determined (by a summation of movement, based on acceleration and time from a known starting position), and there may be provided sensors to sense the relative orientation of each submarine vessel with respect to the submarine vessels in front and behind it, so as to provide suitable inputs to the computer 76 to arrange for the steering means to cause the following submarine vessels to follow the path of the lead vessel.

Alternatively, one can use the geographical positioning system, particularly where the submarine vessel is on or adjacent the surface when for example it is entering a harbour or estuary or river, or is at a shallow depth and can receive signals from the GPS satellites (the depth at which the signal can be received will depend upon the frequency of the signal) or where the GPS receivers are mounted on upright masts above or just below water level At least some of the submersible vessels carry position sensors GPS which may, for example, comprise GPS (geographical positioning system) sensors which sense from a plurality of satellites the exact position of the sensor with respect to the earth's surface.

A computer system 76 is provided whereby the position of the lead vessel over time, and hence its route, is determined from the position sensor (gyroscopic or GPS) in the lead vessel and thus its exact position relative to the earth's surface (both horizontally and if necessary vertically) is determined. In essence, each following vessel which has a position sensor calculates its own position with respect to the position or path followed by the lead submarine, and the computer 76 automatically adjusts the fins and/or thrusters so as to steer the submarine vessel to follow exactly the path of the lead submarine vessel.

It is not necessary for every submarine vessel to have fins and/or side thrusters nor indeed position sensors but a sufficient number of them in a train of submersible vessels are required so as to be able maintain the successive submersible vessels moving along the same path as the lead vessel. In this way it can be ensured that all of the submersible vessels will pass the breakwater or rocks or shoals safely.

Of course, in certain circumstances, such as when docking, or if the automatic computer controlled steering system is faulty, the individual submersible vessels can be independently manually steered.

The length of the submarine is such that a floating offshore platform may be desirable. Goods and passengers could be transshipped at this point or vessels could be coupled together to generate a submarine.

Figure 8:
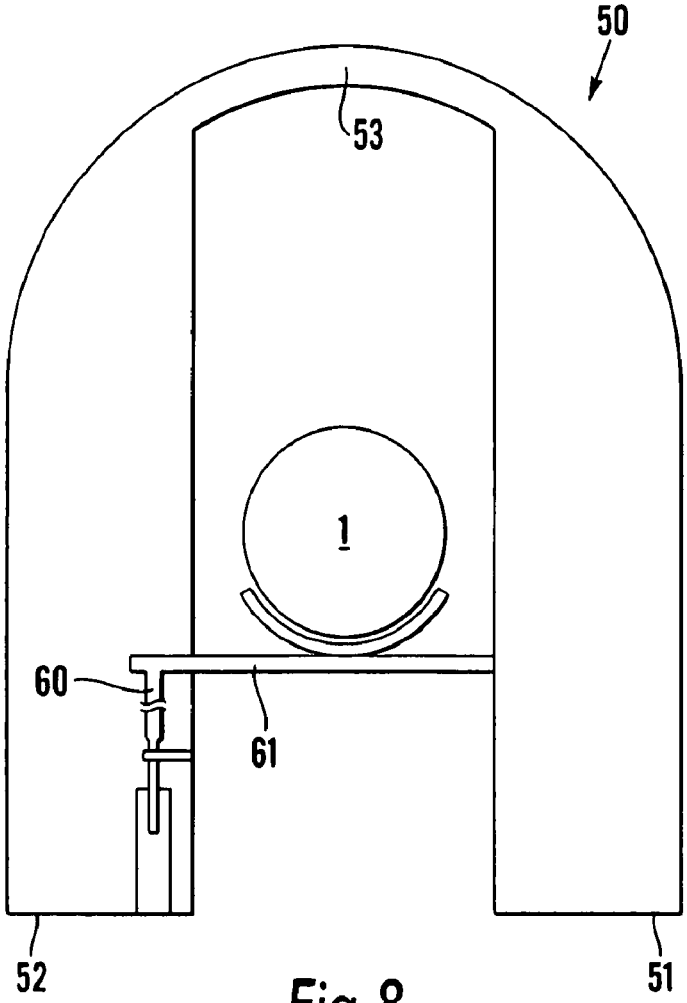
FIGS. 8 and 8A respectively are a schematic cross-section and plan view of a floating harbour.
Figure 8A:
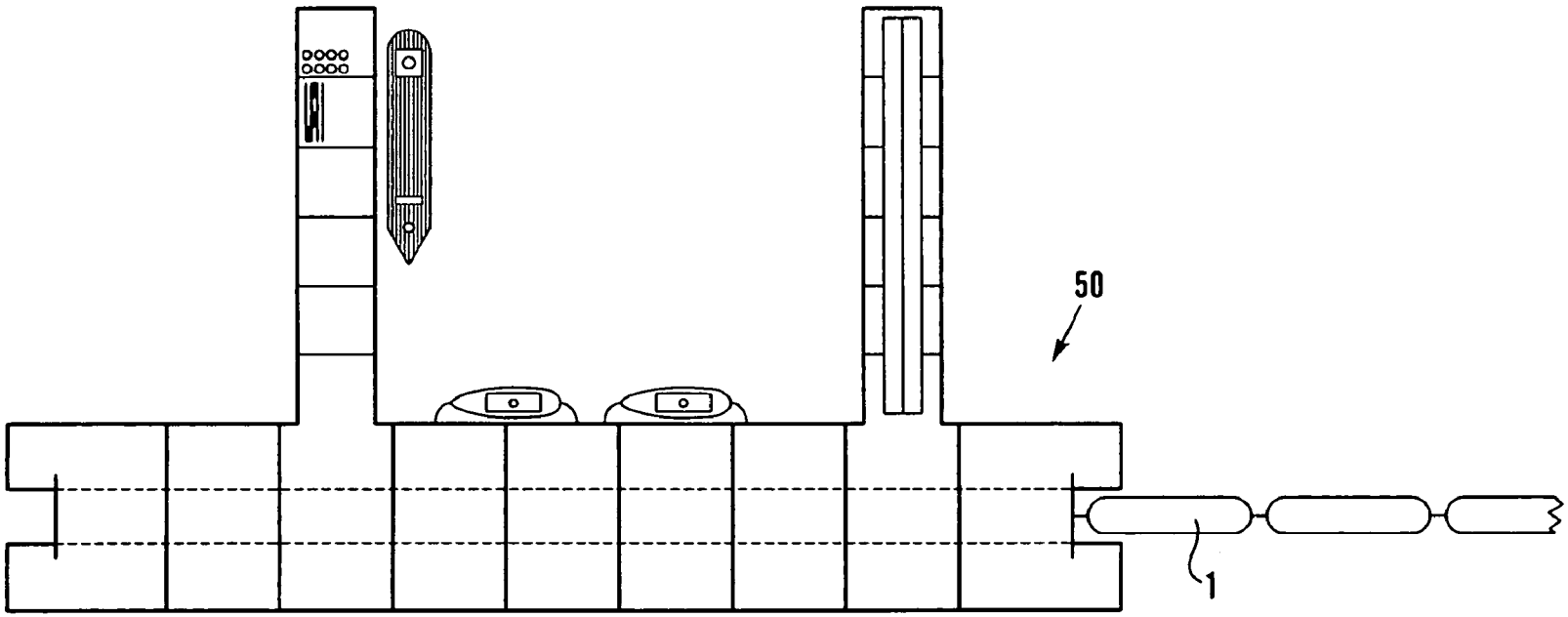

FIGS. 8 and 8A illustrate such an arrangement. Floating harbour 50 comprises keels 51, 52 which may be provided with buoyancy tanks, anchors and/or motive power. Keels 51, 52 are joined for example by bridging member 53. Channel 54 is defined by the keels and bridging member. Submarine 1 is receivable in the channel and may be moored to the floating harbour. Mooring may be by conventional means such as cable.

In some embodiments of the invention at least one upwardly extending hydraulic ram 60 is provided together with means for actuating it. Support member 61 such as a cradle having an upper surface profiled to fit the lower surface of the submarine. Actuation of ram 60 allows the cradle to engage and disengage the submarine thereby allowing mooring of the submarine or vessel or even lifting of the submarine or vessel from the sea.

In some embodiments a detent mechanism is provided on the ram. This may, for example comprise a member with a plurality of holes movable relative to a pin with one of the member and pin being movable with the cradle and the other fixed. When the cradle is in the desired position the detent can be engaged. Pressure can then be released from the hydraulic system.

Navigation of such a large vessel is a problem. There maybe provided a pre-planned route from one particular harbour to another particular harbour, for example from Liverpool to Sydney in the form of a set of instructions as to the particular route to be followed which may be stored on a compact disc. The compact disc player may read the instructions and provide a series of digital signals to control the steering means so as to ensure that the lead vessel and hence the following vessels, follow exactly a particular route which avoids sandbanks, shoals, rocks and the like. There maybe provided a series of compact discs for routes which have been pre-planned between a variety of ports.

In place of the use of compact disc, the information may be stored in any other suitable electronic means such as a flash Memory. The memory device such as the compact disc or flash Memory may include not only route information in terms of position horizontally on the earth's surface, but also depth information so as to ensure that, for example, when the submarine is approaching an estuary or a port that the submarine vessel is directed closer to the surface.

Those skilled in the art will have no difficulty in devising modifications.

What is claimed is:

1. A submersible vehicle comprising a plurality of rigid submersible vessels coupled together end to end by resilient couplings, at least some of said rigid submersible vessels including means to independently steer the relevant submersible vessel, the lead submersible vessel and at least some of the submersible vessels including position tracking means, whereby the position of the relevant vessel may be accurately tracked, and computer means is provided so as to cause said at least some submersible vessels to control their steering means whereby the following submersible vessels follow the path of the lead submersible vessel.

2. A submersible vehicle as claimed in claim 1 in which said steering means comprises generally vertical and/or horizontal fins.

3. A submersible vehicle as claimed in claim 1 in which said steering means comprises side and/or up and down thrusters.

4. A submersible vehicle as claimed in claim 2 in which said steering means is provided at the front and/or the rear of the vessel.

5. A submersible vehicle as claimed in claim 1 in which said position tracking means comprises a global positioning tracking system (GPS) sensor.

6. A submersible vehicle as claimed in claims 1 in which said position tracking means comprises a gyroscopic apparatus.

7. A submersible vehicle as claimed in claim 1 in which the submersible vessels are connected by a cable which allows the data with regard to the positioning system of the submersible vessels to be transferred between submersible vessels.

8. A submersible vehicle as claimed in claim 1 in which the submersible vessels are coupled by resilient couplings adapted to transmit pulling and braking forces between adjacent rigid submersible vessels.

9. A submersible vehicle as claimed in claim 1 wherein said coupling is adapted to limit the maximum angle between the axes of adjacent submersible vessels to 10°.

10. A submersible vehicle as claimed in claim 1 wherein said coupling is adapted to limit the maximum angle between the axes of adjacent submersible vessels to 5°.

11. A submersible vehicle as claimed in claim 1 wherein said coupling is adapted to limit the maximum angle between the axes of adjacent submersible vessels to 2½°.

12. A submersible vehicle as claimed in claim 1 wherein some of the rigid submersible vessels include propulsion means.

13. A submersible vehicle as claimed in claim 12 wherein the vessels including propulsion means are each provided with more than four propellers.

14. A submersible vehicle as claimed in claim 1 wherein each submarine vessel has a length in the range 80 m to 200 m.

15. A submersible vehicle as claimed in claim 14 wherein at least some of the submarine vessels are 100 m to 150 m in length.

* * * * *